US006565164B2

(12) United States Patent
Irwin et al.

(10) Patent No.: US 6,565,164 B2
(45) Date of Patent: May 20, 2003

(54) AUTOMATIC DISHWASHER AND PUSH/PULL LATCH MECHANISM FOR SAME

(75) Inventors: Eric C. Irwin, St. Joseph, MI (US); James R. Bowser, Niles, MI (US); Michael F. Gregory, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 09/870,874

(22) Filed: May 31, 2001

(65) Prior Publication Data

US 2002/0180319 A1 Dec. 5, 2002

(51) Int. Cl.[7] ..... A47B 77/00; E05C 19/06

(52) U.S. Cl. ..... 312/228; 292/DIG. 69

(58) Field of Search ..... 312/215, 228, 312/229; 292/128, 228, 254, DIG. 30, DIG. 69; 134/201

(56) References Cited

U.S. PATENT DOCUMENTS

| | | | | |
|---|---|---|---|---|
| 4,105,229 A | * | 8/1978 | Kaldenberg | 292/DIG. 69 |
| 4,359,250 A | * | 11/1982 | Jenkins | 312/228 |
| 4,776,620 A | | 10/1988 | Marks et al. | |
| 4,940,298 A | * | 7/1990 | Jackson et al. | 312/228 |
| 5,741,054 A | * | 4/1998 | Becker et al. | 312/228 |
| 5,810,403 A | | 9/1998 | Prada | |

FOREIGN PATENT DOCUMENTS

| | | | |
|---|---|---|---|
| DE | 2756366 | * | 6/1979 |
| GB | 2133455 | | 7/1984 |

* cited by examiner

*Primary Examiner*—James O. Hansen
(74) *Attorney, Agent, or Firm*—Robert O. Rice; John F. Colligan; Thomas J. Roth

(57) ABSTRACT

An automatic dishwashing mechanism with a pivoting door that incorporates a push/pull door latch mechanism comprising a moveable strike plate and a positive-return cam. The cam movement is limited such that the door opening force and door closing force are independent of each other.

35 Claims, 9 Drawing Sheets

AUTOMATIC DISHWASHER AND PUSH/PULL LATCH MECHANISM FOR SAME

BACKGROUND OF THE INVENTION

1. Field of the Invention

The invention generally relates to automatic dishwashers for washing cooking utensils. In one aspect the invention relates to a latching mechanism for a door for the automatic dishwasher. In another aspect, the invention relates to a push/pull latch mechanism in which the opening force is independent of the closing force.

2. Description of the Related Art

Known automatic dishwashers include a hinged door and a latch mechanism that prevents the opening of the door and the operation of the dishwasher unless the door is latched in a closed position. Since most dishwashers use a resilient and compressible seal positioned between the door and the dishwasher housing, which inherently applies an opening force to the door when the door is closed, the latch must be able to hold the door in the closed position against the opening force to prevent the inadvertent opening of the door or the leaking of the seal from lack of compression.

Generally, the latches can be segregated into two main categories: a handle-actuated latch and a push/pull latch. U.S. Pat. No. 4,776,620, discloses a handle-actuated latch mechanism that includes a fixed latch housing is provided on the door of a dishwashing apparatus and cooperates with a strike plate on a cabinet, against which the door seats in a closed position, to latch the door in a closed position. The strike plate, in addition to latching the door, concurrently activates a switch, which is fixedly mounted on the door. The strike plate is deformable and is deflected by the latch housing as the door is being closed. Upon the door closed position being realized, the strike plate reassumes its undeflected state wherein it latches the door and activates the switch. Consequently, the structure will positively prohibit operation of the dishwashing apparatus until the door is latched. In order to open the door, a handle is moved which deflects the strike plate away from the latch housing and the switch, deactivating the switch, and enabling the door to be opened.

The push/pull latching mechanism eliminates the need for a movable handle. A common implementation of a push/pull latch utilizes a spring-biased over-center cam and a rigid strike plate. The over-center cam is pivotal between two positions corresponding to the door latched and the door unlatched positions. In the door closed position, the spring force acting on the over-center cam must be sufficient to maintain the cam in the latched position against the inherent opening force of the door. Conversely, in the door open position, the spring force must be sufficient to maintain the cam in the unlatched position until the door is closed. Inadvertent return of the cam to the latched position will render the door inoperable. Thus, the door closure force and door opening force are interdependent, and must be carefully tuned to provide an adequate closure force without also developing too high an opening force, which is very undesirable to most users. Thus, there is a need for a latching mechanism which provides adequate door closure force without too high an opening force, and which can be inexpensively manufactured and assembled.

SUMMARY OF THE INVENTION

In one aspect, the present invention preferably comprises an automatic washer comprising a housing with a rear wall from which extends a peripheral wall that collectively define a wash chamber, with the peripheral wall terminating in an edge that defines an access opening providing access to the wash chamber. A door is pivotally mounted to the housing for movement between a closed position, wherein the door overlies the access opening, and an open position, wherein the door is away from the access opening A strike is mounted to one of the housing and the door and is movable relative thereto. The strike has a cam retainer, and the cam is pivotally mounted to the other of the housing and the door for pivotal movement from a latch position, wherein the cam is received within the cam retainer, and a release position, wherein the cam is released from the cam retainer. The cam is located on the other of the housing and the door so that the cam remains substantially fixed relative to the other of the housing and the door while the strike contacts a cam surface of the cam, causing the strike to follow the cam and move relative to the one of the housing and the door until the cam is received in the cam retainer, which results in the cam moving into the latch position as the door is moved from the open to the closed position, and the cam moving into abutting relationship with the strike causing the pivoting of the cam from the latch position to the release position as the door is moved from the closed position to the open position.

Preferably, the cam is biased toward the latch position by a spring mounted to the cam and the other of the housing and the door. The spring has a predetermined spring force to control the door opening force independent of the door closing force. The strike can be a flexible plate having one end mounted to the one of the housing and the door and another end for abutting the cam. The cam retainer can have several suitable structures and is preferably an opening near the another end of the strike.

In an alternative form, the strike is a reciprocally-mounted U-shaped catch, the interior of which defines the cam retainer opening. In yet another embodiment of this aspect of the invention, the cam surface is an inclined surfaces facing the strike.

A stop can extend from the other of the housing and the door into the pivotal path of the cam at a location that prevents the cam from pivoting beyond the latch position as the cam pivots from the release to the latch position.

The automatic washer can further include a switch and a plunger for actuating the switch, both of which are mounted to the other of the housing and the door. The plunger is moveable between an actuating and non-actuating position and is located on the other of the housing and the door so that the strike contacts the plunger and moves it from the non-actuating to the actuating position as the door is moved from the open to the closed position. The plunger can further comprise a guide for receiving an end of the strike to direct the strike into abutting relationship with the plunger as the door is moved from the open to the closed position.

A latch housing can be provided and is mounted to the other of the housing and the door. The cam is pivotally mounted to the latch housing, the switch is mounted to the latch housing, and the plunger is slidably mounted to the latch housing to form a subassembly.

In another aspect, the present invention comprises a latch for an automatic washer comprising a rear wall from which extends a peripheral wall, which collectively define a wash chamber. The peripheral wall terminates in an edge that defines an access opening providing access to the wash chamber, and a door is pivotally mounted to the housing for movement between a closed position, wherein the door overlies the access opening, and an open position, wherein the door is away from the access opening. The latch comprises a strike adapted to mount to one of the housing and the door and moveable relative thereto and having a cam retainer. A cam is adapted to pivotally mount to the other of the housing and the door for pivotal movement from a latch position, wherein the cam is positioned to be received within the cam retainer, and a release position, wherein the cam is positioned to be released from the cam retainer. The cam remains substantially fixed relative to the strike while the strike contacts a cam surface of the cam causing the strike to follow the cam until the cam is received in the cam retainer as the door is moved from the open to the closed position. The cam is moved into abutting relationship with the strike causing the pivoting of the cam from the latch position to the release position as the door is moved from the closed position to the open position.

In yet another aspect, the present invention comprises an improvement for an automatic washer comprising a housing with a rear wall from which extends a peripheral wall that collectively define a wash chamber. The peripheral wall terminates in an edge that defines an access opening providing access to the wash chamber. A door is pivotally mounted to the housing for movement between a closed position, wherein the door overlies the access opening, and an open position, wherein the door is away from the access opening. A compressible and resilient seal is disposed between the peripheral wall edge and the door to seal the door relative to the housing when the door is in the closed position wherein the seal is compressed when the door is in the closed position and applies an opening force to the door in a direction that urges the door toward the open position. The improvement comprises a push/pull latch for retaining the door in the closed position and being moveable from a latch position, where the door is retained in the closed position against the door opening force, to a release position, where the door is free to move away from the housing toward the open position in response to the application of a latch opening force to the push/pull latch, and the latch opening force is independent of the door closing force.

DESCRIPTION OF THE PREFERRED EMBODIMENT

Figure 1:
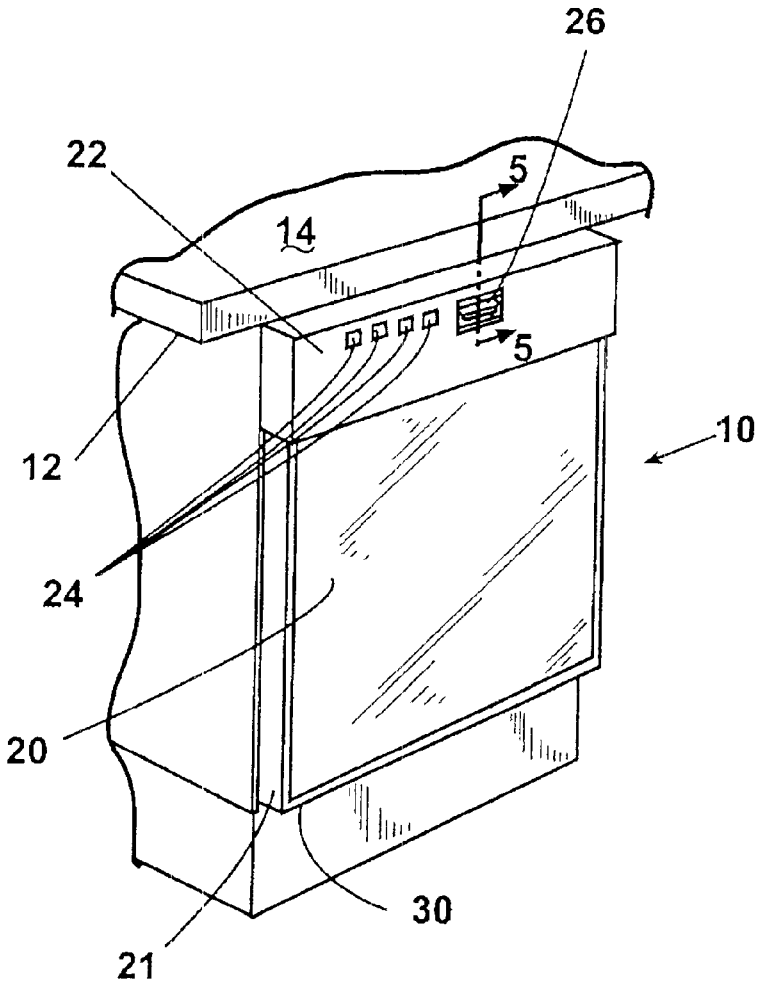
FIG. 1 is a perspective view of a dishwashing apparatus incorporating a housing and a door with a door latching mechanism according to the present invention.

In FIG. 1, a dishwasher suitable for the incorporation of the present invention is shown at 10. The dishwasher in FIG. 1 is an under-the-counter design wherein the dishwasher 10 resides closely beneath the underside 12 of a countertop 14.

Figure 2:
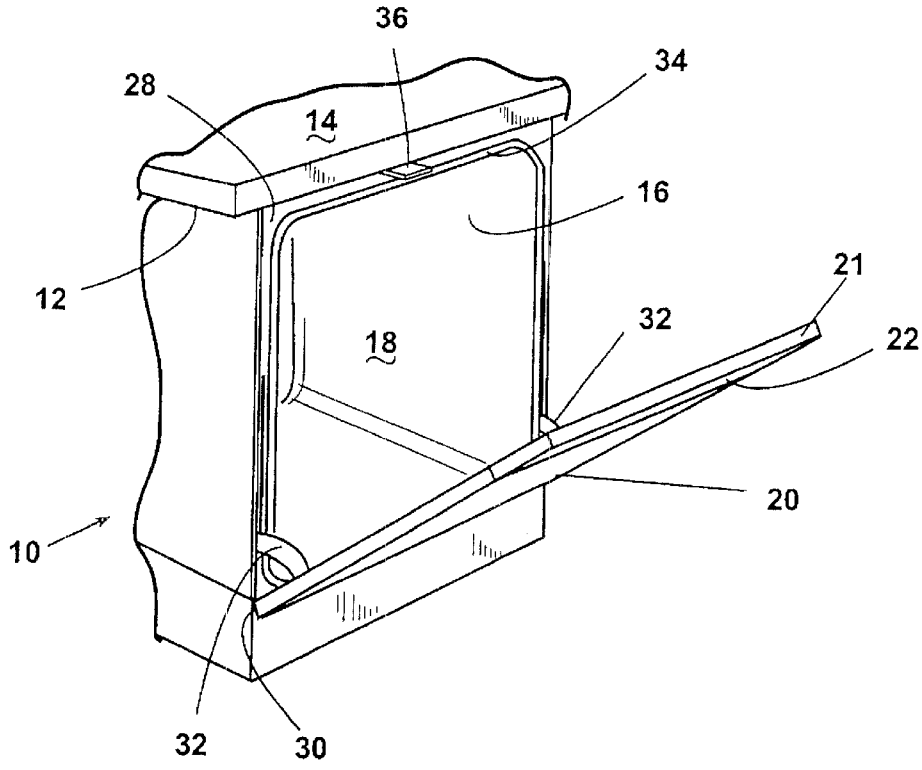
FIG. 2 is a perspective view of the dishwashing apparatus of FIG. 1 showing the door in an open position, an interior of the dishwashing apparatus, and a strike plate mounted to a housing frame.

Referring to FIGS. 1 and 2, the dishwasher 10 comprises a tub 16 that defines a wash chamber 18 which accepts a plurality of racks (not shown) for supporting dishes and utensils. The wash chamber 18 has an access opening at its front which is selectively closed by a hinged door 20, shown in FIG. 1 in a closed position and in FIG. 2 in a partially open position.

Figure 3:
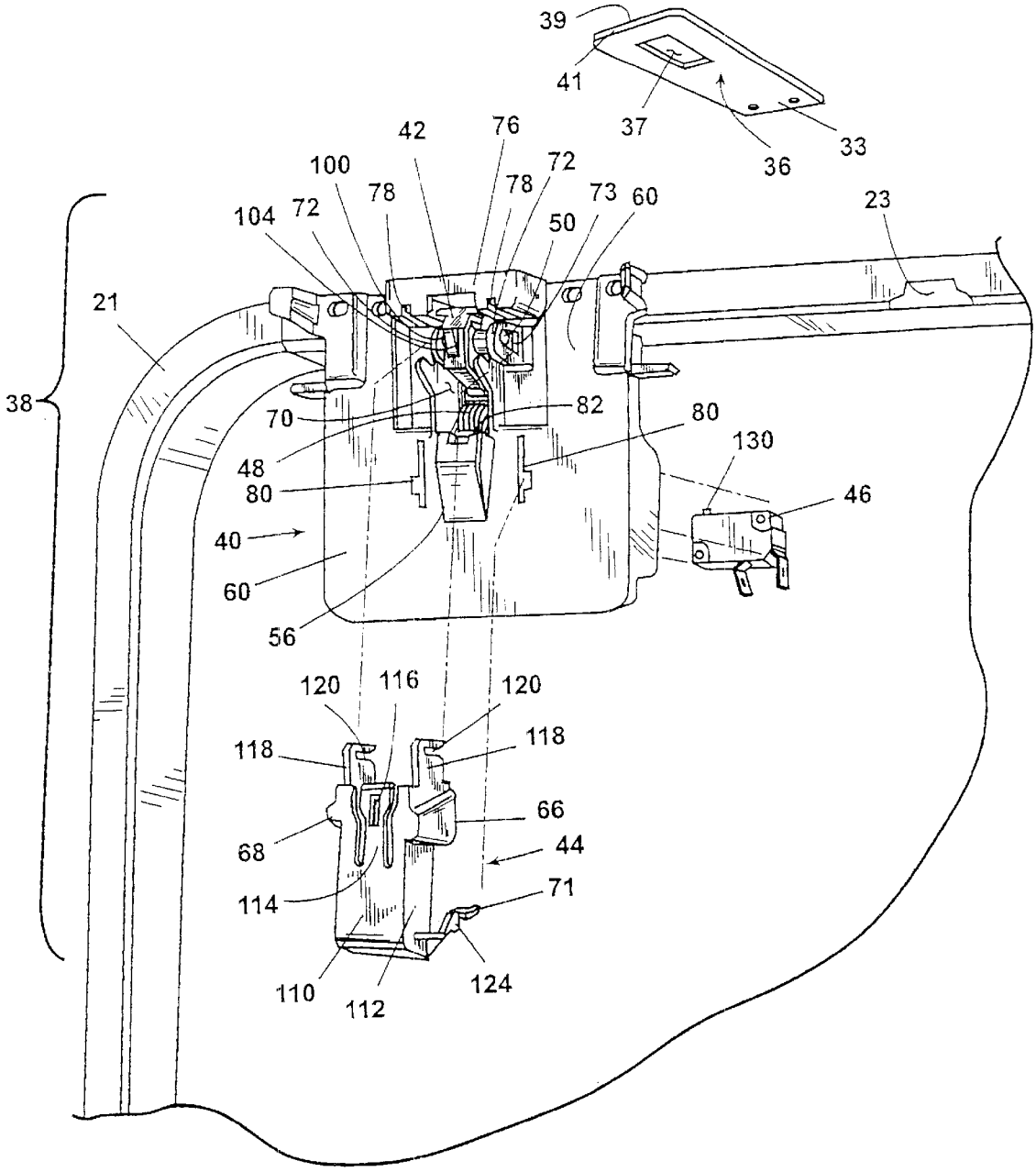
FIG. 3 is a partial exploded view of a portion of the door, the door latching mechanism, and the strike plate of FIG. 2.

Referring to FIGS. 1–3, the door 20 is comprised of a peripheral frame 21 with an opening 23 for receipt of a strike plate as hereinafter described, and a console 22 which houses the control mechanism for the dishwasher and supports operator controls 24. The door 20 also has a non-moveable pull handle 26 for opening and closing the door.

As can be readily understood by one skilled in the art, the door 20 is hingedly supported to pivot about its bottom edge 30 for making pivotable connection with hinge elements 32 that are part of a forward frame 28 (see FIG. 2) that extends peripherally up the sides and over the top of the tub 16. The forward frame 28 is preferably made of metal, such as steel. A resilient gasket 34, preferably made of rubber, is affixed to the frame 28 in a conventional manner along the periphery of the tub opening. When the door 20 is in the closed position, the inside surface of the door 20 abuts and compresses the gasket 34 to form a watertight seal. With the door 20 in the closed position, the door 20 is latched and released by a door latching mechanism 38 at the upper portion of the door 20.

Figure 4:
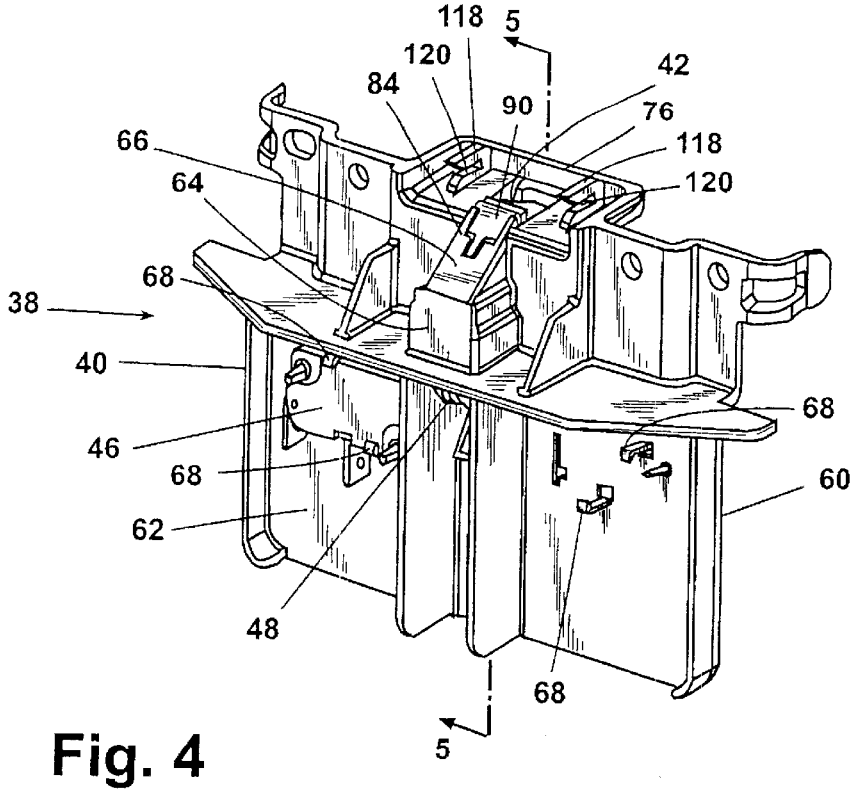
FIG. 4 is an assembled perspective view of the rear of the door latching mechanism of FIG. 3.
Figure 5:
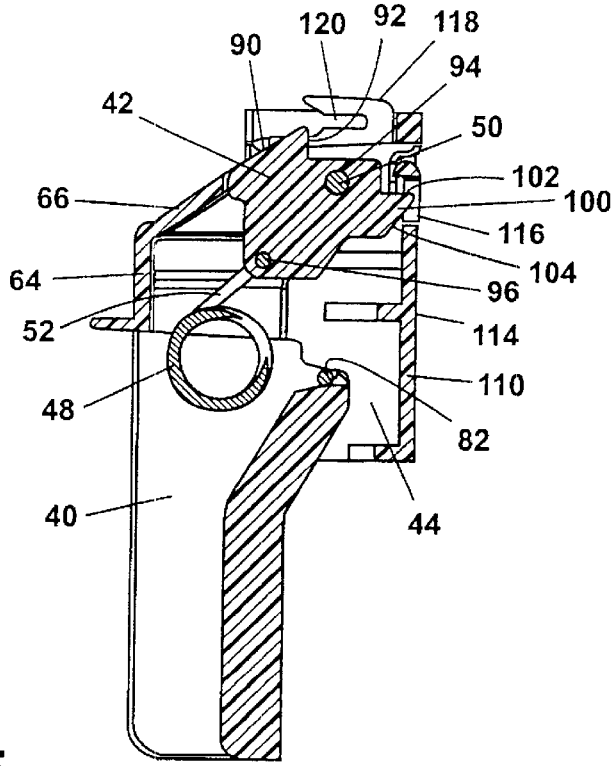
FIG. 5 is a sectional view through line 5—5 of the door latching mechanism of FIG. 4 showing the assembly of a latch housing, a cam, a spring, and a plunger.
Figure 6:
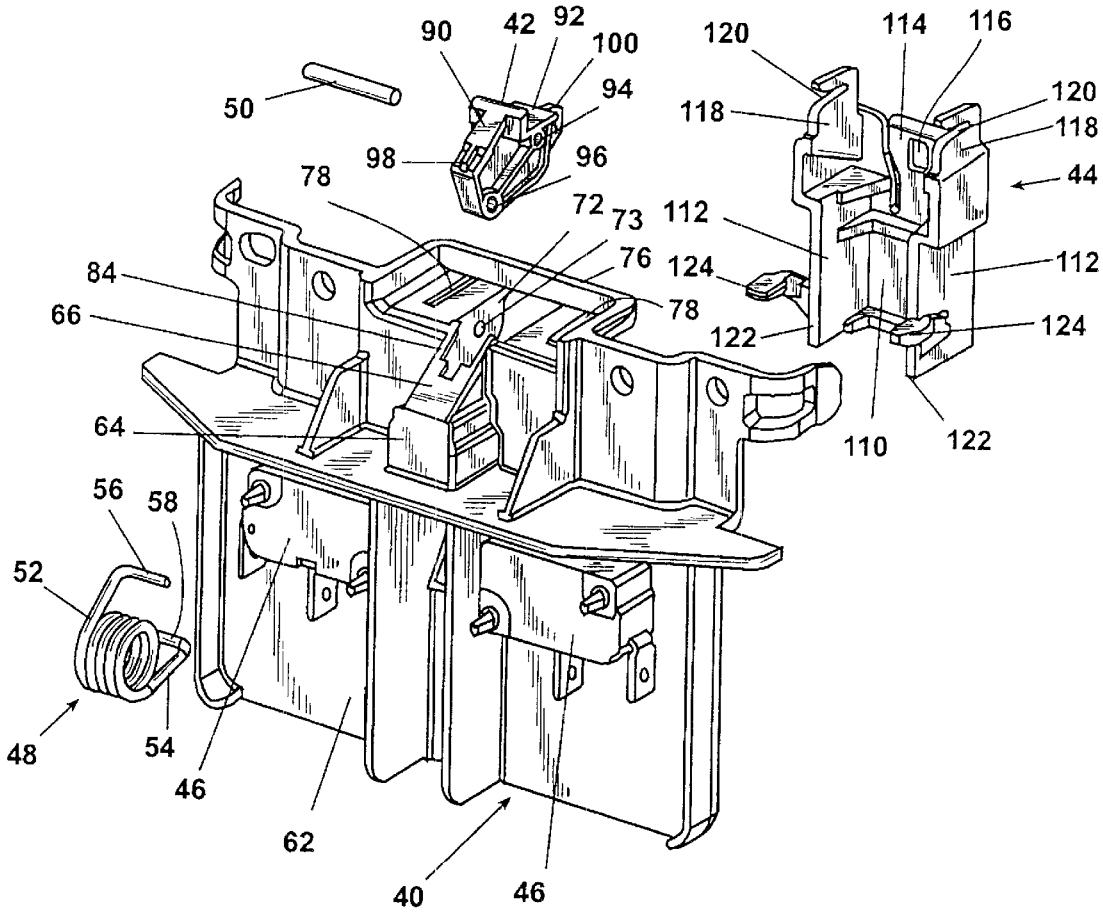
FIG. 6 is an exploded view of the rear of the door latching mechanism of FIG. 4.

Referring to FIG. 3, the latching mechanism 38 includes a latch housing 40, a cam 42, a plunger 44, a switch 46, a spring 48, and the strike 36. In the preferred embodiment, the latch housing 40 is supported within the console 22. Threaded fasteners (not shown) are preferably used to attach the latch housing 40 to bosses (not shown) provided in the console 22. The latch housing 40 includes a front surface 60 and a rear surface 62 (FIG. 4). When supported within the console 22, the rear surface 62 faces into the wash chamber 18. The strike 36 is a flexible, elongated, generally plate-like member with a fixed end 33 fixedly mounted to the frame 28 and a free end 39 adapted to engage the latch housing 40 as hereinafter described. The free end 39 is provided with a cam retainer 37 which, in the preferred embodiment, comprises a slot penetrating therethrough. The free end 39 terminates in an edge 41.

Referring now to FIGS. 3–6, the latch housing rear surface 62 comprises a pedestal 64 with an inclined face 66 which is inclined upwardly from the rear surface 62 toward the front surface 60. The underside of the inclined face 66 comprises a cam stop 84. The latch housing rear surface 62 also comprises opposing pairs of spring fingers 68 adapted to retain at least one microswitch 46. The latch housing front surface 60 comprises a receptacle 70 extending from the top of the latch housing 40 in a generally downward direction. The upper portion of the receptacle 70 comprises a pair of pin flanges 72, each of which contains an axially aligned pin aperture 73. At the top of the latch housing front surface 60 is a strike tray 76 extending orthogonal to the latch housing front surface 60. The strike tray 76 is provided with elongated plunger slots 78 extending therethrough. The latch housing 40 is also provided with plunger switch arm slots 80 extending therethrough on either side of the intersection of the receptacle 70 and the strike tray 76. The lower edge of the receptacle 70 further comprises a spring bearing channel 82 extending across the receptacle 70.

The cam 42 comprises a generally flattened, irregularly-shaped member with an inclined face 90 and a vertical face 92. A pin aperture 94 extends through the upper portion of the cam 42, and a spring aperture 96 extends through the lower portion of the cam 42. The inclined face 90 terminates in a stop surface 98 at its lower end. Opposite the inclined face 90, extending outward from the cam 42 body is a plunger catch 100. The plunger catch 100 is a projection comprising a horizontal edge 102 and an inclined edge 104.

The plunger 44 is an irregularly-shaped member comprising a plunger back 110 and a pair of plunger sides 112 orthogonal thereto. The plunger sides 112 define an edge 122. Extending upwardly from the back 110 is a spring arm 114. The spring arm 114 is attached to the back 110 in cantilever fashion. Extending through the upper portion of the spring arm 114 is a cam plunger catch slot 116. Extending upwardly from the sides 112 are control arms 118 containing a strike slot 120. Extending laterally from the sides 112 and to the front of the plunger 44 are a pair of switch arms 124.

The spring 48 is provided with a pair of tangentially extending spring arms 52, 54, each of which terminates in a spring finger 56, 58, respectively. The spring fingers 56, 58 extend orthogonal to the spring arms 52, 54, respectively, parallel to the longitudinal axis of the spring 48.

The assembly of the latch mechanism 38 will now be described. The cam 42 is inserted into the receptacle 70 so that the inclined face 90 of the cam 42 is aligned with the inclined face 66 of the latch housing 40. The pin 50 is inserted through the pin apertures 73 in the pin flanges 72 and the pin aperture 94 in the cam 42 to pivotally retain the cam 42 in the receptacle 70. As so positioned, the cam 42 can pivot from a first position, in which the cam inclined face 90 is coplanar with the pedestal inclined face 66 and the vertical face 92 is parallel to the plane of the latch housing 40, to a second position, in which the vertical face 92 is inclined toward the rear of the latch housing 40. The cam 42 is prevented from pivoting past the first position by the stop surface 98 of the cam 42 contacting the cam stop 84 of the latch housing 40.

The spring finger 56 is inserted into the spring aperture 96, and the spring finger 58 is placed in the spring bearing channel 82. With the spring 48 so positioned, the spring arms 52, 54 will be urged toward each other, and the spring arm 54 will exert a force against the bottom of the channel 82, tending to retain the spring finger 58 in the channel 82. Similarly, the spring arm 52 will exert an upward force against the cam 42 tending to rotate the cam 42 to the first position in which the inclined faces 66, 90 remain coplanar. Rotation of the cam 42 away from this position will be resisted by the spring 48.

The plunger 44 is positioned against the front surface 60 of the latch housing 40 by inserting in the control arms 118 into the plunger slots 78, while at the same time inserting the switch arms 124 through the plunger switch arm slots 80. When the plunger 44 is properly positioned relative to the latch housing 40 and the cam 42, the plunger catch 100 will engage the spring arm 114 and be retained in the cam plunger catch slot 116, and the edge 122 will be in slidable communication with the latch housing front surface 60. The plunger 44 will slide relative to the latch housing 40 with the movement of the plunger catch 100 as the cam 42 pivots.

Microswitches 46 are retained against the rear surface 62 by locking engagement with the spring fingers 68. When the microswitches 46 are properly positioned, the switch arms 124 on the plunger 44 will engage the switch buttons 130. Movement of the plunger 44 in a downward direction will depress the switch buttons 130. Conversely, the switch buttons 130 will be released when the plunger 44 is moved in an upward direction.

Figure 7:
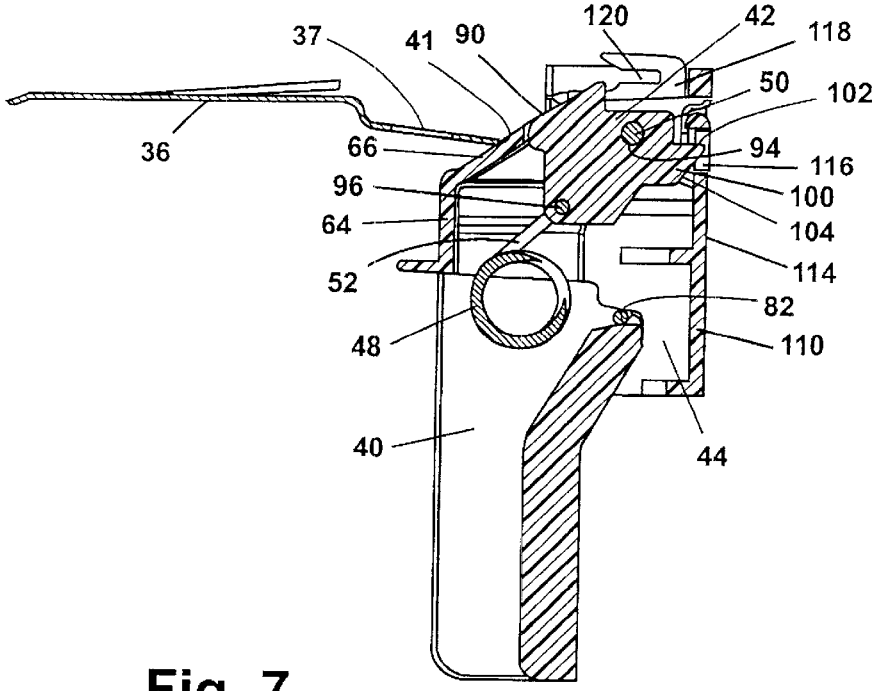
FIG. 7 is the sectional view of the latch of FIG. 5 in combination with the strike plate and showing the initial contact between the strike plate and an inclined face of the latch as the door is moved toward a closed position.
Figure 8:
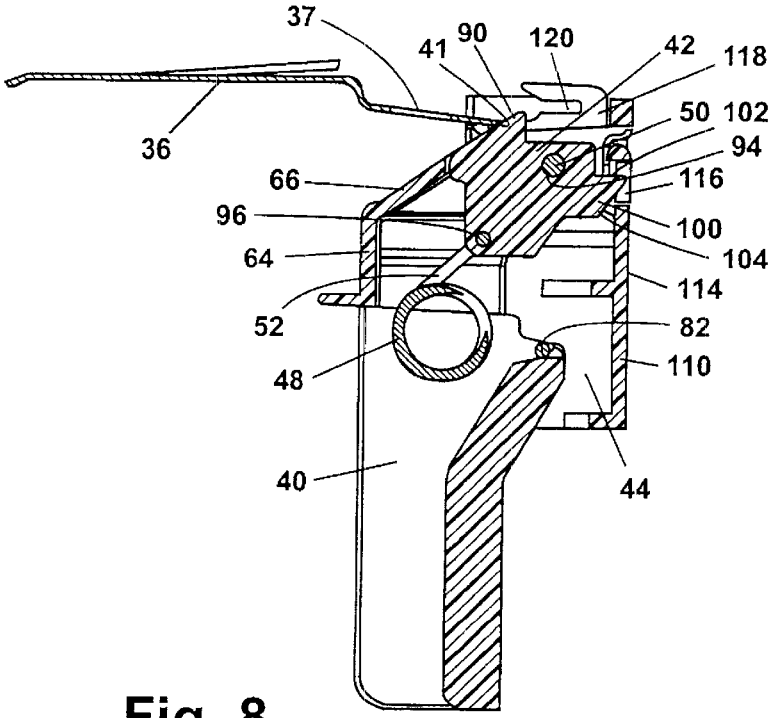
FIG. 8 is similar to FIG. 7 and shows the strike contacting the cam as the door is further moved toward a closed position.
Figure 9:
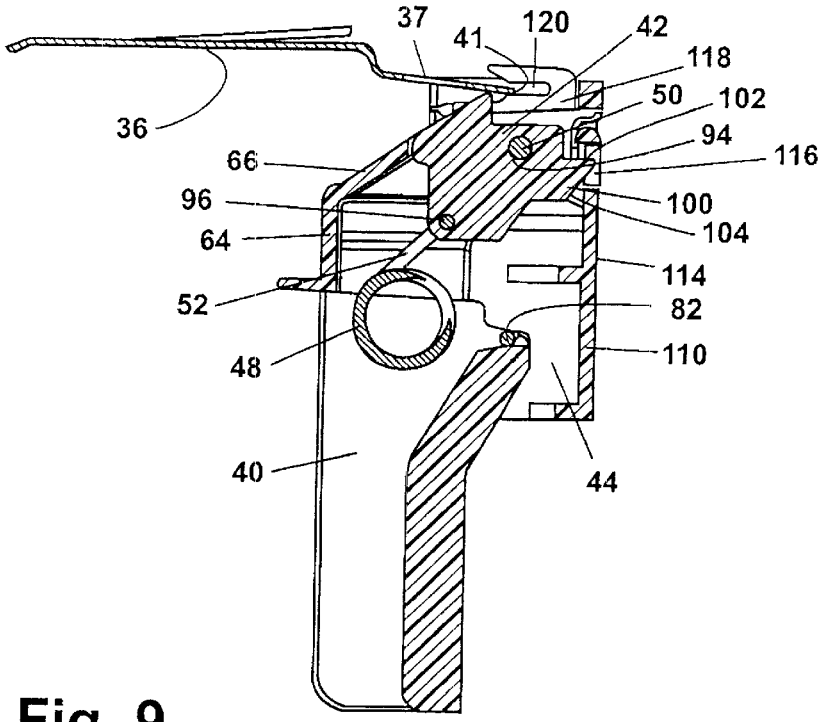
FIG. 9 is similar to FIGS. 7 and 8 and shows the strike plate clearing the cam as the door is further moved toward a closed position.
Figure 10:
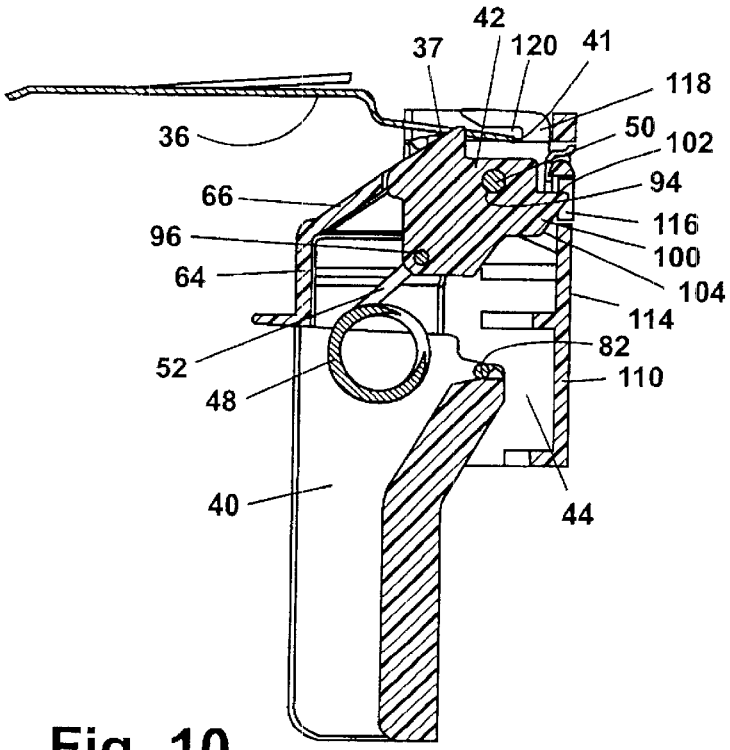
FIG. 10 is similar to FIGS. 7–9 and shows the latch mechanism in a latched position where the cam is received within a recess in the strike plate, which is depressing the plunger to activate at least one switch, when the door is in the closed position.

The operation of the latching mechanism will now be described with reference to FIGS. 7–12. As the door 20 is moved toward a closed position, the latch housing 40 is brought into proximity to the strike 36. The front edge of the strike 36 contacts the inclined face 66 (FIG. 7). As the door 20 is further moved toward a closed position, the strike 36 deflects upward and the front edge 41 moves up the inclined face 66 to contact the inclined face 90 of the cam 42 (FIG. 8). The front edge 41 of the strike 36 continues up the inclined face 90 until it clears the top of the cam 42 (FIG. 9). As the strike 36 clears the top of the cam 42, the front edge 41 of the strike 36 engages the strike slots 120 in the plunger 44. The apex of the cam formed by the inclined surface 90 and the vertical face 92 are received within the cam retainer 37. The inherent resiliency of the strike 36 causes the strike 36 to unflex toward an undeflected position. However, the strike 36 remains somewhat flexed with the front edge 41 of the strike 36 in abutting relationship with the vertical face 92. As the strike 36 moves toward an unflexed position, the plunger 44 is urged in a downward direction as the front edge 41 of the strike 36 pushes down on the control arms 118 (FIG. 10). The downward movement of the plunger 44 causes the switch arms 124 to depress the switch buttons 130, allowing the dishwasher to operate. The door 20 will be retained in a closed position by the strike 36 remaining in contact with the vertical face 92. The gasket 34 will exert an opening force against the door 20 tending to pivot the door 20 to an open position. This opening force is resisted by the spring force which tends to maintain the cam 42 in a position in which the vertical face 92 remains vertical.

Figure 11:
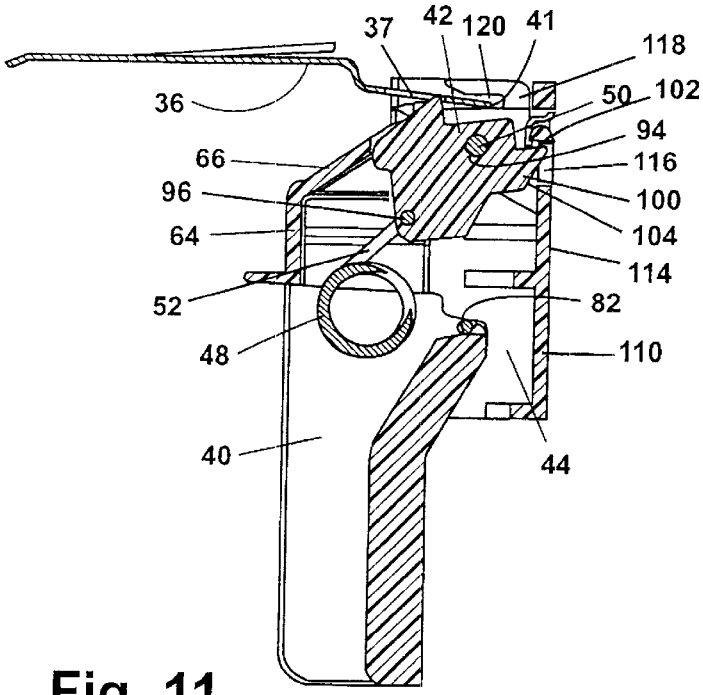
FIG. 11 is similar to FIGS. 7–10 and shows the initial relative movement of the strike plate and the cam with the strike engaging a vertical face of the cam as the door is moved from the closed position toward an open position.
Figure 12:
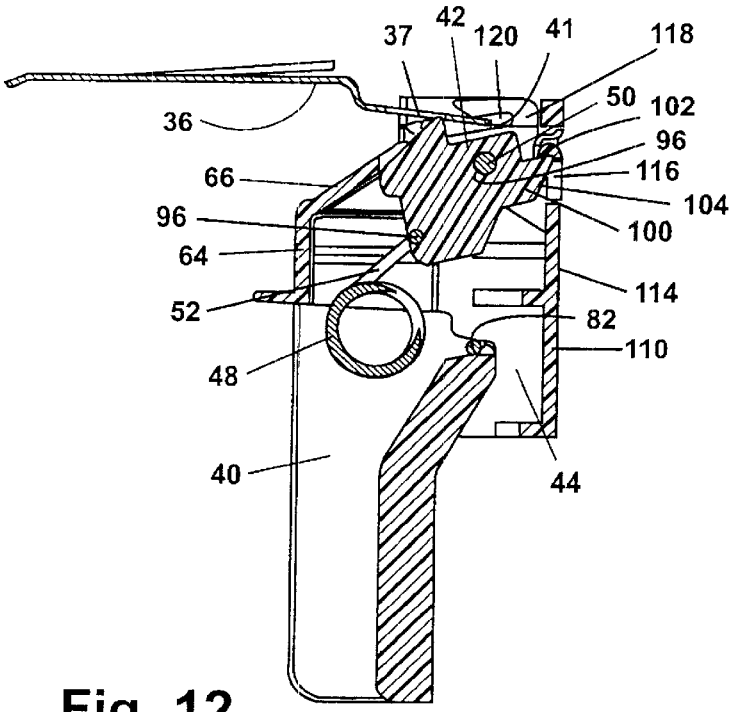
FIG. 12 is similar to FIGS. 7–11 and shows the cam rotating toward the strike as the strike clears the cam allowing the door to be moved to an open position.

To open the door 20, the operator grasps the handle 26 and pulls the door 20 away from the tub 16 and pivoting in a downward direction. Pulling the door 20 moves the vertical face 92 against the strike 36 (FIG. 11). As the combined force of the user pulling on the door 20 and the opening force exerted by the gasket 34 exceed the spring force, the cam 42 will begin to pivot about the pin 50. As the cam 42 pivots, the vertical face 92 becomes inclined. The inclination of the vertical face 92 allows the door 20 to be moved away from the strike 36. The strike 36 will move in an upward direction as it travels along the now-inclined face 92, at the same time exerting an upward force on the control arms 118, and urging the plunger 44 in an upward direction, thereby releasing the switch buttons 130. The pivoting of the cam 42 also urges the plunger 44 in an upward direction due to the upward movement of the plunger catch 100 inserted into the cam plunger catch slot 116. When the strike 36 clears the cam 42 (FIG. 12), the door can then be completely opened. The spring 48 will then return the cam 42 to its closed position.

Upward movement of the plunger 44 during opening of the door is essential to the proper actuation of the switch 46 to suspend the operation of the dishwasher when the door is opened. The movement of the plunger 44 is assured by the redundancy described above. Under normal operating conditions, the plunger 44 is moved by the upward deflection of the strike 36 against the control arms 118, and by the upward movement of the plunger catch 100 against the cam plunger catch slot 116. Nevertheless, either of these mechanisms alone will move the plunger 44 to actuate the switch 46.

Figure 13:
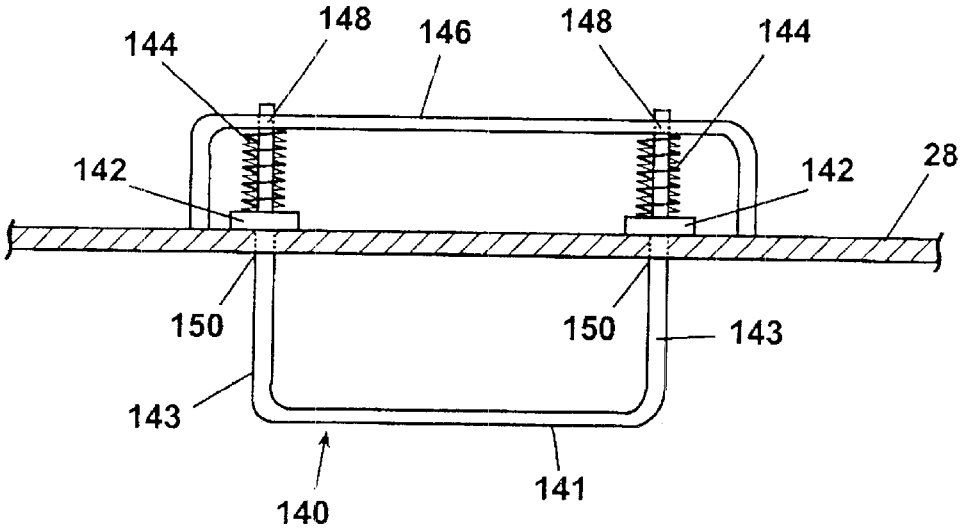
FIG. 13 shows an alternative embodiment of the strike comprising a U-shaped strike with a cross piece that engages the cam and that is deflectable upward as the cross piece travels up the inclined face as the door is moved toward the closed position.

Referring now to FIG. 13, an alternative embodiment of the strike is shown. In this embodiment, the strike comprises a U-shaped member 140 with a narrow cross-section, such as heavy wire, a crosspiece 141 and parallel arms 143 extending orthogonal to the crosspiece 141. The frame 28 is provided with lower strike apertures 150 suitable for slidable receipt of the arms 143. The arms 143 are provided with stop flanges 142. Springs 144 encircle the arms 143 and bear against the stop flanges 142. Attached to the frame 28 is a strike frame 146. The strike frame 146 is an elongated, U-shaped member provided with upper strike apertures 148. The strike frame 146 is rigidly attached to the frame 28, such as by welding. The apertures 148, 150 are aligned so that the arms 143 can slide therein. The springs 144 bear against the underside of the strike frame 146. Movement of the strike 140 in an upward direction will compress the springs 144, which will tend to return to the strike 140 to its initial position in which the stop flanges 142 bear against the frame 28. As the door 20 is moved toward a closed position, the crosspiece 141 will contact the inclined faces 66, 90, and will be urged in an upward direction. As the crosspiece 141 clears the top of the cam 42, it will engage the slots 120, the springs 144 will urge the strike 140 in a downward direction, which will depress the plunger 44, thus activating the switches 46. As the door 20 is moved toward an open position, the crosspiece 141 will contact the vertical face 92 of the cam 42, rotating the cam 42 so that the vertical face 92 is inclined. With the vertical face 92 inclined, the crosspiece 141 will travel up the face 92, and will clear the cam 42, allowing the door 20 to be opened and allowing the cam 42 to return to its closed position.

An advantage of the current invention over prior dishwashers with push/pull latches is that door closing force is independent of the spring force for the cam because the cam is not rotated in response to the closing of the door. Prior over-center cams would require that the cam spring force be overcome during both the closing and the opening of the door. The cam spring force of the current invention is only "felt" by the user upon the opening of the door. An additional advantage of the current structure is that the door closing and opening forces can effectively be individually and independently set since the cam spring force only comes into play upon opening the door. By controlling the effective force of the gasket, and to a lesser extent the moveable strike, the door closing force can be set. The door opening force is controlled by selecting the spring force for the cam spring.

The invention has been described herein with reference to its use for an automatic dishwasher. It will be readily appreciated by one skilled in the art that the invention is also suitable for use with other cabinet and door assemblies. While the invention has been specifically described in connection with certain specific embodiments thereof, it is to be understood that this is by way of illustration and not of limitation, and the scope of the appended claims should be construed as broadly as the prior art will permit.

What is claimed is:

1. An automatic washer comprising:

a housing comprising a rear wall from which extends a peripheral wall that collectively define a wash chamber, the peripheral wall terminates in an edge that defines an access opening providing access to the wash chamber;

a door pivotally mounted to the housing for movement between a closed position, wherein the door overlies the access opening, and an open position, wherein the door is away from the access opening;

a strike mounted to one of the housing and the door and moveable relative thereto and having a cam retainer; and a cam pivotally mounted to the other of the housing and the door for pivotal movement from a latch position, wherein the cam is received within the cam retainer, and a release position, wherein the cam is released from the cam retainer;

wherein the cam is located on the other of the housing and the door so that the cam remains substantially fixed relative to the other of the housing and the door while the strike contacts a cam surface of the cam causing the strike to follow the cam and move relative to the one of the housing and the door until the cam is received in the cam retainer to move the cam into the latch position as the door is moved from the open to the closed position, and the cam is moved into abutting relationship with the strike causing the pivoting of the cam from the latch position to the release position as the door is moved from the closed position to the open position.

2. The automatic washer of claim 1 wherein the cam is biased toward the latch position.

3. The automatic washer of claim 2 and further comprising a spring mounted to the cam and the other of the housing and the door to bias the cam toward the latch position.

4. The automatic washer of claim 3 wherein the spring has a predetermined spring force to control the door opening force independent of the door closing force.

5. The automatic washer of claim 1 wherein the strike is a flexible plate having one end mounted to the one of the housing and the door and another end for abutting the cam.

6. The automatic washer of claim 5 wherein the cam retainer is an opening near the another end of the strike.

7. The automatic washer of claim 5 wherein the plate is made of metal.

8. The automatic washer of claim 1 wherein the cam retainer is an opening in the strike.

9. The automatic washer of claim 8 wherein the strike is a U-shaped catch the interior of which defines the cam retainer opening.

10. The automatic washer of claim 9 wherein the U-shaped catch is reciprocally moveable relative to the one of the housing and door.

11. The automatic washer of claim 1 wherein the cam surface is an inclined surface facing the strike.

12. The automatic washer of claim 1 and further comprising a stop extending from the other of the housing and door into the pivotal path of the cam at a location that prevents the cam from pivoting beyond the latch position as the cam pivots from the release to the latch position.

13. The automatic washer of claim 1 and further comprising a switch and a plunger for actuating the switch, both of which are mounted to the other of the housing and the door, the plunger is moveable between an actuating and non-actuating position and is located on the other of the housing and the door so that the strike contacts the plunger and moves it from the non-actuating to the actuating position as the door is moved from the open to the closed position.

14. The automatic washer of claim 13 wherein the plunger comprises a guide for receiving an end of the strike to direct the strike into abutting relationship with the plunger as the door is moved from the open to the closed position.

15. The automatic washer of claim 14 and further comprising a latch housing mounted to the other of the housing and the door wherein the cam is pivotally mounted to the latch housing, the switch is mounted to the latch housing, and the plunger is slidably mounted to the latch housing to form a subassembly that can be mounted to the other of the housing and the door.

16. The automatic washer of claim 15 and further comprising a spring disposed between the latch housing and the cam to bias the cam to the latch position.

17. The automatic washer of claim 15 wherein the latch housing comprises a stop that extends into the pivotal path of the cam to prevent the cam from pivoting beyond the latch position.

18. The automatic washer of claim 13 wherein the cam further comprises a catch that contacts the plunger to move it from the actuation to the non-actuation position as the cam is pivoted from the latch to the release position as the door is moved from the closed to the open position.

19. A latch for an appliance comprising a rear wall from which extends a peripheral wall, which collectively define a chamber, the peripheral wall terminates in an edge that defines an access opening providing access to the chamber, and a door pivotally mounted to the housing for movement between a closed position, wherein the door overlies the access opening, and an open position, wherein the door is away from the access opening, the latch comprising:

a strike adapted to mount to one of the housing and the door and moveable relative thereto and having a cam retainer; and a cam adapted to pivotally mount to the other of the housing and the door for pivotal movement from a latch position, wherein the cam is positioned to be received within the cam retainer, and a release position, wherein the cam is positioned to be released from the cam retainer;

wherein the cam remains substantially fixed relative to the strike while the strike contacts a cam surface of the cam causing the strike to follow the cam until the cam is received in the cam retainer as the door is moved from the open to the closed position, and the cam is moved into abutting relationship with the strike causing the pivoting of the cam from the latch position to the release position as the door is moved from the closed position to the open position.

20. The latch of claim 19 wherein the cam is biased toward the latch position.

21. The latch of claim 20 and further comprising a spring mounted to the cam to bias the cam toward the latch position.

22. The latch of claim 21 wherein the spring has a predetermined spring force to control the door opening force independent of the door closing force.

23. The latch of claim 19 wherein the cam retainer is an opening in the strike.

24. The latch of claim 23 wherein the strike is a U-shaped catch the interior of which defines the cam retainer opening.

25. The latch of claim 23 wherein the strike is a flexible plate having one end adapted to mount to the one of the housing and the door and another end for abutting the cam, and the retainer opening is formed in the plate near the another end.

26. The latch of claim 19 and further comprising a latch housing adapted to mount to the other of the housing and the door wherein the cam is pivotally mounted to the latch housing to form a subassembly.

27. The latch of claim 26 and further comprising a spring disposed between the latch housing and the cam to bias the cam to the latch position.

28. The latch of claim 26 wherein the latch housing comprises a stop that extends into the pivotal path of the cam to prevent the cam from pivoting beyond the latch position as the cam pivots from the release to the latch position.

29. In an automatic washer comprising:

a housing comprising a rear wall from which extends a peripheral wall that collectively define a wash chamber, the peripheral wall terminates in an edge that defines an access opening providing access to the wash chamber;

a door pivotally mounted to the housing for movement between a closed position, wherein the door overlies the access opening, and an open position, wherein the door is away from the access opening; and a compressible and resilient seal disposed between the peripheral wall edge and the door to seal the door relative to the housing when the door is in the closed position wherein the seal is compressed when the door is in the closed position and applies an opening force to the door in a direction that urges the door toward the open position; the improvement comprising:

a push/pull latch for retaining the door in the closed position and being moveable from a latch position, where the door is retained in the closed position against the door opening force, to a release position, where the door is free to move away from the housing toward the open position in response to the application of a latch opening force to the push/pull latch, and the latch opening force is independent of the door closing force, the push/pull latch comprising:

a strike mounted to one of the housing and the door and moveable relative thereto and having a cam retainer;

a cam pivotally mounted to the other of the housing and the door for pivotal movement from a latch position, wherein the cam is received within the cam retainer, and a release position, wherein the cam is released from the cam retainer; and a spring mounted to the cam and the other of the housing and the door to bias the cam toward the latch position and resist the pivoting of the cam toward the release position independently of the door opening force.

30. The automatic washer of claim 29 wherein the cam is located on the other of the housing and the door so that the cam remains substantially fixed relative to the other of the housing and the door while the strike contacts a cam surface of the cam causing the strike to follow the cam and move relative to the one of the housing and the door until the cam is received in the cam retainer to move the cam into the latch position as the door is moved from the open to the closed position, and the cam is moved into abutting relationship with the strike causing the pivoting of the cam from the latch position to the release position as the door is moved from the closed position to the open position.

31. The latch of claim 29 wherein the cam retainer is an opening in the strike.

32. The latch of claim 31 wherein the strike is a U-shaped catch the interior of which defines the cam retainer opening.

33. The latch of claim 32 wherein the strike is a flexible plate having one end adapted to mount to the one of the housing and the door and another end for abutting the cam, and the retainer opening is formed in the plate near the another end.

34. The latch of claim 29 and further comprising a latch housing adapted to mount to the other of the housing and the door wherein the cam is pivotally mounted to the latch housing to form a subassembly.

35. The latch of claim 34 wherein the spring is disposed between the latch housing and the cam to bias the cam to the latch position.

* * * * *